US005222416A

United States Patent [19]

Shakhov

[11] Patent Number: 5,222,416

[45] Date of Patent: Jun. 29, 1993

[54] PIVOTING HOLDER FOR PROTECTING THE SHOE OF THE DRIVER OF A VEHICLE

[76] Inventor: Ilya Shakhov, 62 Villa Nova St., Staten Island, N.Y. 10314

[21] Appl. No.: 737,155

[22] Filed: Jul. 29, 1991

[51] Int. Cl.[5] ..... G05G 1/18

[52] U.S. Cl. ..... 74/564; 74/512

[58] Field of Search ..... 74/560, 564, 512; 280/291; 296/75; 180/90.6

[56] References Cited

U.S. PATENT DOCUMENTS

| | | | |
|---|---|---|---|
| 984,571 | 2/1911 | Croix | 74/564 |
| 1,218,047 | 3/1913 | Bill | 74/564 |
| 1,316,180 | 9/1919 | Peden | 74/564 |
| 1,433,859 | 10/1922 | Snyder | 74/564 |
| 1,476,592 | 12/1923 | Carlson | 74/564 |
| 2,761,329 | 9/1956 | Reed | 74/564 |
| 3,386,541 | 6/1968 | Luijt | 74/560 X |
| 4,089,233 | 5/1978 | Sebald | 74/502.1 X |
| 4,828,215 | 5/1989 | Mittelhauser | 74/502.1 X |
| 4,940,321 | 7/1990 | Yoshida | 74/502.1 X |

*Primary Examiner*—Allan D. Herrmann
*Attorney, Agent, or Firm*—Richard L. Miller

[57] ABSTRACT

A pivoting heel holder is provided for a driver of a vehicle and the like which consists of a bracket mountable to a floor of a vehicle in front of and between the brake pedal and the accelerator pedal. A receptacle is formed to receive the curved back heel portion of the driver's shoe. A mechanism is connected between the bracket and the receptacle, for permitting swiveling of the receptacle, so that the sole of the shoe can make contact with either the brake pedal or accelerator pedal while resting in the receptacle thereby eliminating the wearing out of the heel of the shoe.

2 Claims, 1 Drawing Sheet

PIVOTING HOLDER FOR PROTECTING THE SHOE OF THE DRIVER OF A VEHICLE

BACKGROUND OF THE INVENTION

The instant invention relates generally to gas pedal mechanisms and more specifically it relates to a pivoting heel holder for driving a vehicle and the like.

Numerous gas pedal mechanisms have been provided in the prior art that are adapted to be pressed by a shoe on the foot of a driver for controlling the speed of the engines of motor vehicles. For example, U.S. Pat. Nos. 3,857,304 to Berndt; 4,356,471 to Nienaber and 4,369,670 to Papenhagen et al. all are illustrative of such prior art. While these units may be suitable for the particular purpose to which they address, they would not be as suitable for the purpose of the present invention as hereafter described.

SUMMARY OF THE INVENTION

A primary object of the present invention is to provide a pivoting heel holder for driving a vehicle and the like that will overcome the shortcomings of the prior art devices.

Another object is to provide a pivoting heel holder for driving a vehicle and the like that is mounted in front of the accelerator and brake pedals so that the heel of a shoe of the driver can rest therein to prevent wear on the heel of the driver's shoe.

An additional object is to provide a pivoting heel holder for driving a vehicle and the like so that the heel of the shoe of the driver can pivot and swivel between the accelerator and brake pedals within a receptacle attached to a ball carried in a socket in a floor mounting bracket.

A further object is to provide a pivoting heel holder for driving a vehicle and the like that is simple and easy to use.

A still further object is to provide a pivoting heel holder for driving a vehicle and the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWINGS

The figures in the drawings are briefly described as follows.

DETAILED DESCRIPTION OF THE PREFERRED EMBODIMENTS

Figure 1:
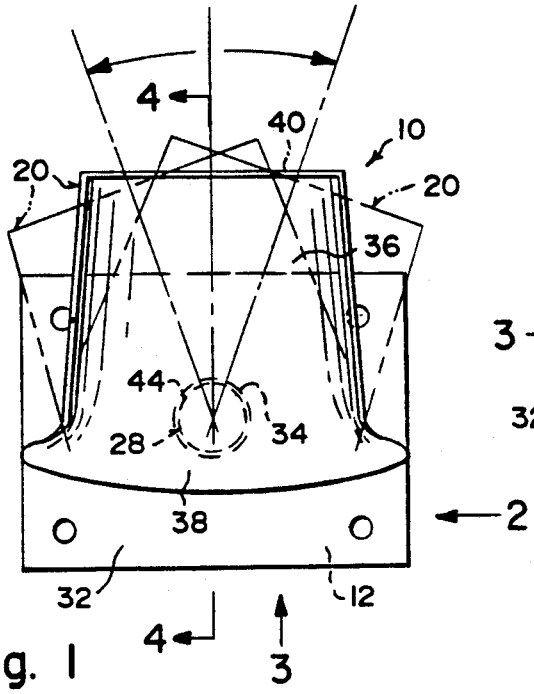
FIG. 1 is a top plan view of the instant invention taken in the direction of arrow 1 in FIGS. 2 and 3.
Figure 2:
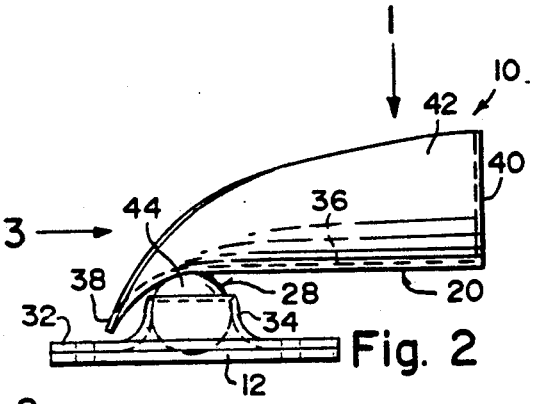
FIG. 2 is a side elevational view taken in the direction of arrow 2 in FIGS. 1 and 3.
Figure 5:
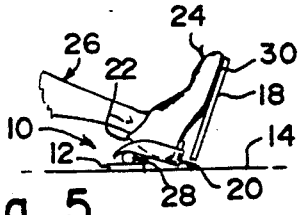
FIG. 5 is a diagrammatic side elevational view illustrating the instant invention in use cooperating with a heel of a shoe operating an accelerator pedal.
Figure 3:
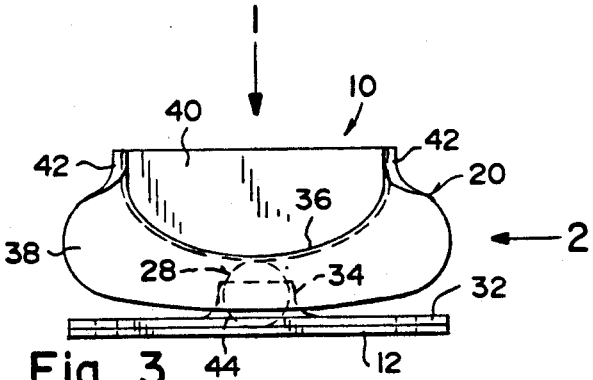
FIG. 3 is a front elevational view taken in the direction of arrow 3 in FIGS. 1 and 2.
Figure 6:
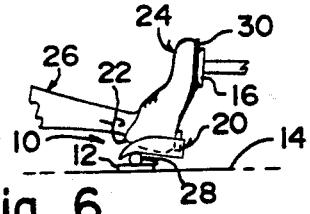
FIG. 6 is a diagrammatic side elevational view illustrating the instant invention in use cooperating with a heel of a shoe operating a brake pedal.
Figure 7:
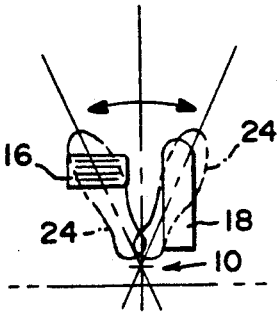
FIG. 7 is a diagrammatic top plan view illustrating how the instant invention is located so as to permit the driver's foot to swivel between both the accelerator pedal and the brake pedal.

Turning now descriptively to the drawings, in which similar reference characters denote similar elements throughout the several views, the Figures illustrate a pivoting heel holder 10 for driving a vehicle and the like which consists of a bracket 12 mounted with fasteners 13 to a floor 14 of the vehicle in front and between a brake pedal 16 and accelerator pedal 18. A receptacle 20 is to receive the curved back heel portion 22 of a shoe 24 from a driver 26 of the vehicle. A mechanism 28 is connected between the bracket 12 and the receptacle 20 for permitting swiveling of the receptacle 20, so that the sole 30 of the shoe 24 can make contact with either the brake pedal 16 or accelerator pedal 18. The bracket further includes a plate 32 having a socket 34 affixed to the top of the bracket 12.

The receptacle 20 includes an upwardly curved bottom wall 36 having a downwardly curved forward portion 38. A rear wall 40 extends upwardly from the bottom wall 36. A pair of tapered side walls 42 extend upwardly from the bottom wall 36 so that the curved back heel portion 22 can fit therein.

Figure 4:
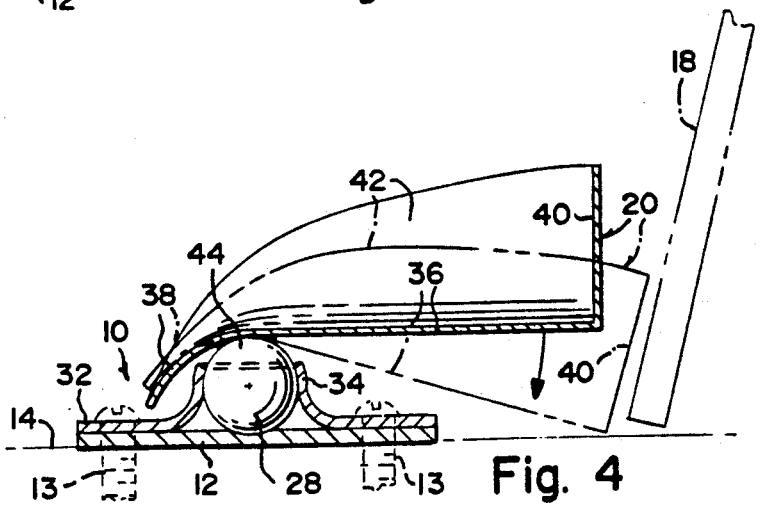
FIG. 4 is an enlarged partial cross sectional view taken along line 4—4, in FIG. 1.

The swiveling mechanism 28 includes a ball 44, affixed to the underside of the bottom wall 36, proximate the forward portion 38 of the receptacle 20 with the ball 44 rotatively captured within the socket 34 of the plate 32 so that the ball 44 and the receptacle 20 can swivel thereabout in orthogonal planes, i.e. horizontal and vertical planes, as shown by arrows in FIGS. 1 and 4, respectively, in which different positions are illustrated by broken lines.

When the bracket 12 is in position on the floor 14 the driver 26 can place the curved back heel portion 22 of his/her shoe 24 into the receptacle 20 and adjust his/her foot so that the sole 30 of his/her shoe 24 can make contact with either the brake pedal 16 or the accelerator pedal 18. This will prevent the wearing out of the curved back heel portion 22 during normal driving conditions.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pivoting heel holder for a shoe of a driver of a vehicle which comprises:

a) a bracket for mounting in a stationary position to a floor of the vehicle in front of and between a brake pedal and an accelerator pedal, wherein said bracket further includes a plate having a socket affixed to a top of said bracket;

b) a receptacle shaped for receiving a curved back portion of a shoe of a driver of the vehicle, wherein said receptacle includes:

i) an upwardly curved bottom wall having a downwardly curved forward portion;

ii) a rear wall extending upwardly from said bottom wall; and iii) a pair of tapered side walls extending upwardly from said bottom wall so that the curved back heel portion can fit therein; and c) means connected between said bracket and said receptacle, for permitting swiveling of said receptacle by a shoe received therein in orthogonal planes about a fixed point, so that a sole of the shoe can depress a brake pedal and an accelerator pedal alternatively.

2. A pivoting heel holder as recited in claim 1, wherein said swiveling means includes a ball affixed to an underside of said bottom wall, proximate the forward portion of said receptacle with said ball rotatively captured within a socket of said plate so that said ball and said receptacle can swivel thereabout.

* * * * *